US008397641B1

(12) United States Patent
Jackson

(10) Patent No.: US 8,397,641 B1
(45) **Date of Patent: *Mar. 19, 2013**

(54) NON-NEWTONIAN PROJECTILE

(76) Inventor: Jason Stewart Jackson, Atlanta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/158,382

(22) Filed: Jun. 11, 2011

Related U.S. Application Data

(60) Continuation of application No. 12/348,189, filed on Jan. 2, 2009, now Pat. No. 7,966,937, which is a continuation-in-part of application No. 11/957,412, filed on Dec. 15, 2007, now abandoned, which is a division of application No. 11/480,694, filed on Jul.1, 2006, now Pat. No. 7,373,887.

(Continued)

(51) Int. Cl.
*F42B 30/02* (2006.01)
*F42B 12/74* (2006.01)
*F42B 12/34* (2006.01)

(52) U.S. Cl. ..... 102/517; 102/510; 102/501

(58) Field of Classification Search ..... 102/501, 102/506, 507, 508, 509, 510, 516, 517
See application file for complete search history.

(56) References Cited

U.S. PATENT DOCUMENTS

| | | | |
|---|---|---|---|
| 843,017 | A | 2/1907 | Hoxie |
| 896,021 | A | 8/1908 | Hoxie |
| 1,004,510 | A | 9/1911 | Watson |
| 1,096,558 | A | 5/1914 | Newton |
| 1,155,901 | A | 10/1915 | Duncan |
| 1,512,026 | A | 8/1922 | Holden |
| 1,493,614 | A | 5/1924 | Dickerman |
| 1,709,414 | A | 4/1929 | Stendebach |
| 1,833,645 | A | 11/1931 | Hartz |
| 3,348,486 | A | 10/1967 | Rapp |
| 3,429,263 | A | 2/1969 | Snyder |
| 3,754,507 | A | 8/1973 | Dillinger |
| 3,782,287 | A | 1/1974 | Sie |
| 3,795,196 | A | 3/1974 | Hillenbrand |
| 3,861,311 | A | 1/1975 | Bilsbury |
| 3,911,820 | A | 10/1975 | Canon |
| 3,941,057 | A | 3/1976 | Peterson |
| 3,948,325 | A | 4/1976 | Winston |
| 3,972,286 | A | 8/1976 | Canon |
| 3,983,817 | A | 10/1976 | Tucker |
| 3,991,684 | A | 11/1976 | Pritchard |
| 4,015,528 | A | 4/1977 | Barr |
| 4,108,073 | A | 8/1978 | Davis |
| 4,136,616 | A | 1/1979 | Schirneker |
| 4,193,348 | A | 3/1980 | Halverson |
| 4,245,557 | A | 1/1981 | Knappworst |
| 4,352,225 | A | 10/1982 | Schreiber |
| 4,417,521 | A | 11/1983 | Dahlitz |
| 4,419,936 | A | 12/1983 | Coates |
| 4,448,106 | A | 5/1984 | Knapp |

(Continued)

OTHER PUBLICATIONS

Kurchan and Sellitto "Shear-thickening and the glass transition" PMMH-ESPCI Paris 2006.

(Continued)

*Primary Examiner* — James Bergin

(57) ABSTRACT

A projectile is provided comprising a body with a channel that contains a non-Newtonian fluid. In various embodiments a plunger is located in the channel, wherein the plunger transmits a force to the non-Newtonian fluid upon interacting with a target, causing the non-Newtonian fluid to exert a pressure in the channel, and wherein the viscosity of the non-Newtonian fluid changes upon interacting with the target. By way of non-limiting example, the non-Newtonian fluid of embodiments of the present invention can comprise a shear-thickening fluid that increases its viscosity with at least the rate of shear upon interacting with the target.

47 Claims, 5 Drawing Sheets

Related U.S. Application Data

(60) Provisional application No. 61/102,006, filed on Oct. 1, 2008, provisional application No. 61/077,486, filed on Jul. 2, 2008.

(56) References Cited

U.S. PATENT DOCUMENTS 4,550,662 A 11/1985 Burczynski
4,610,061 A 9/1986 Halverson
4,619,203 A 10/1986 Habbe
4,648,324 A 3/1987 McDermott
4,649,829 A 3/1987 Bilsbury
4,655,140 A 4/1987 Schirneker
4,665,827 A 5/1987 Ellis
4,742,774 A 5/1988 Flatau
4,770,102 A 9/1988 Bisping
4,774,889 A 10/1988 Wallow
4,776,279 A 10/1988 Peisa
4,777,883 A 10/1988 Chevich
4,829,904 A 5/1989 Sullivan
4,836,110 A 6/1989 Burczynski
4,878,434 A 11/1989 Sommet
4,882,822 A 11/1989 Burczynski
4,947,755 A 8/1990 Burczynski
5,009,166 A 4/1991 Bilsbury
5,025,730 A 6/1991 Petrovich
5,069,138 A 12/1991 Ekbom
5,078,054 A 1/1992 Ashok
5,086,703 A 2/1992 Klein
5,097,768 A 3/1992 Petrovich
5,149,913 A 9/1992 Arakaki
5,185,495 A 2/1993 Petrovich
5,187,325 A 2/1993 Garvison
5,198,616 A 3/1993 Anderson
5,208,424 A 5/1993 Schluckebier
5,259,320 A 11/1993 Brooks
5,291,833 A 3/1994 Boual
5,304,331 A 4/1994 Leonard
5,325,787 A 7/1994 Boual
5,333,552 A 8/1994 Corzine
5,349,907 A 9/1994 Petrovich
5,385,101 A 1/1995 Corzine
5,417,004 A 5/1995 Krantz
5,440,994 A 8/1995 Alexander
5,446,987 A 9/1995 Lee
5,454,325 A 10/1995 LeBlanc
5,565,649 A 10/1996 Tougeron
5,621,186 A 4/1997 Carter
5,641,937 A 6/1997 Carter
5,760,329 A 6/1998 Baum
5,763,819 A 6/1998 Huffman
6,085,661 A 7/2000 Halverson
6,090,178 A 7/2000 Benini
6,115,894 A 9/2000 Huffman
6,119,600 A 9/2000 Burri
6,148,731 A 11/2000 Winter
6,176,186 B1 1/2001 Engel
6,178,890 B1 1/2001 Burczynski
6,186,071 B1 2/2001 Fry
6,186,072 B1 2/2001 Hickerson
6,213,022 B1 4/2001 Pullum
6,263,798 B1 7/2001 Benini
6,305,292 B1 10/2001 Burczynski
6,317,946 B1 11/2001 Beal
6,374,743 B1 4/2002 Hug
6,405,654 B1 6/2002 Smith
6,526,893 B2 3/2003 May
6,530,328 B2 3/2003 Burczynski
6,553,913 B1 4/2003 Wardlaw
6,581,522 B1 6/2003 Julien
6,619,211 B1 9/2003 Haeselich
6,675,718 B1 1/2004 Parker
6,691,623 B1 2/2004 Stone
6,772,695 B2 8/2004 Kellner
6,772,696 B2 8/2004 Kellner
6,789,484 B2 9/2004 Kellner
6,792,869 B2 9/2004 Pi
6,805,057 B2 10/2004 Carr
6,837,165 B2 1/2005 Eberhart
6,845,717 B1 1/2005 Sauvestr
6,959,648 B2 11/2005 Piela
6,964,232 B2 11/2005 Eberhart
6,971,315 B2 12/2005 Knappworst
6,973,879 B1 12/2005 McElroy
6,997,110 B2 2/2006 Rastegar
7,004,074 B2 2/2006 Stratum
7,226,878 B2 6/2007 Wagner
7,299,733 B2 11/2007 Eberhart
7,299,750 B2 11/2007 Schikora
7,360,491 B2 4/2008 Sanborn
7,373,887 B2 5/2008 Jackson
7,380,502 B2 6/2008 Emary
7,380,503 B2 6/2008 Williams
7,487,727 B2 2/2009 Eberhart
7,498,276 B2 3/2009 Wagner
7,503,261 B2 3/2009 Burri
7,520,224 B2 4/2009 Taylor
7,765,934 B2 8/2010 Spatz
7,814,837 B2 10/2010 Sauvestre
7,825,045 B1 11/2010 Wagner
7,966,937 B1 6/2011 Jackson
7,980,180 B2 7/2011 MacDougall
8,001,879 B2 8/2011 Williams
8,074,574 B2 12/2011 Riess
8,082,850 B2 12/2011 Marx
2003/0089264 A1 5/2003 Eberhart
2003/0167956 A1 9/2003 Kellner
2004/0003747 A1 1/2004 Hietanen
2005/0038406 A1 2/2005 Epstein
2005/0126422 A1 6/2005 Lamm
2006/0040576 A1 2/2006 Citterio
2007/0017409 A1 1/2007 Mansfield
2007/0079721 A1 4/2007 Webb

OTHER PUBLICATIONS

Rockwood CommuniCLAY "Laponite®—Performance-focused attributes in rheology and specialty film forming applications" vol. 1 Issue 3 Jun. 21, 2001.

Yuntao Hu S. Q. Wang and A. M. Jamieson "Rheological and flow birefringence studies of a shear-thickening complex fluid—A surfactant model system" The Society of Rheology Inc. J. Rheology 37(3) May/Jun. 1993.

R. Shankar Subramanian "Non-Newtonian Flows" 2002.

Wetzel and Wagner "Novel Flexible Body Armor Utilizing Shear Thickening Fluid (STF) Composites" 14th International Conference on Composite Materials San Diego CA Jul. 14, 2003.

"The Cambridge Polymer Group Silly Putty™ "Egg"" Cambridge Polymer Group 2002.

NON-NEWTONIAN PROJECTILE

CROSS-REFERENCE TO RELATED APPLICATIONS

This application is a continuation of U.S. application Ser. No. 12/348,189, filed Jan. 2, 2009 now U.S. Pat. No. 7,966,937, which claims priority to U.S. Provisional Application Ser. No. 61/102,006, filed Oct. 1, 2008 and U.S. Provisional Application Ser. No. 61/077,486, filed Jul. 2, 2008, and which is a continuation-in-part of U.S. application Ser. No. 11/957,412, filed Dec. 15, 2007 now abandoned, which is a divisional of U.S. application Ser. No. 11/480,694, filed Jul. 1, 2006, now U.S. Pat. No. 7,373,887, each of which is herein incorporated by reference in its entirety.

BACKGROUND OF THE INVENTION

Expanding projectiles or bullets as known in the art have several advantages over bullets which are not designed to promote expansion, such as "full metal jacket" or "round nose" bullets. For example, when an expanding bullet travels through a target, it can expand, transferring its kinetic energy to the target. Since an expanding bullet can transfer more of its kinetic energy to the target than can a round-nose bullet, for example, an expanding bullet is less likely to exit the target and cause undesired damage. Accordingly, expanding bullets are useful in military, law enforcement, and sporting applications.

Hollow-point bullets are expanding bullets that contain a cavity or "hollow-point" at the front of the bullet. Upon striking a target, the hollow point fills with material from the target, in effect creating a "wedge" or "penetrater" out of the target material. As the hollow-point bullet travels through the target, the target material is forcefully driven into the hollow point, expanding the front of the bullet. In this manner, a hollow-point bullet with sufficient kinetic energy can expand well beyond its original diameter. Further, the loss of kinetic energy due to expansion slows the velocity of the hollow-point bullet, making it less likely that it will exit the target and cause unintentional damage. At a sufficiently high velocity a hollow-point bullet may break into two or more pieces, or fragment, while it is traveling through the target, transferring a large portion of its kinetic energy to the target while further reducing the likelihood of unintentional harm.

Hollow-point bullets have several drawbacks. If bullet velocity is not optimal, then the front of the bullet may only slightly expand, or not expand at all. Hollow-point bullets often fail to expand when the hollow point becomes clogged with certain types of target material, such as heavy clothing or drywall. Often, the forward part of a hollow point may expand slightly and then be sheared off, leaving a cylindrical projectile to travel through and exit the target, transferring less kinetic energy to the target and increasing the likelihood of unintentional harm.

To promote bullet expansion, some projectiles utilize a wedge-like solid "ballistic tip" or "penetrater" at the front end of the bullet. Upon striking a target, the penetrater is driven into the bullet, causing the front of the bullet to expand. At sufficiently high velocities the penetrater of a ballistic-tip bullet may be driven far enough within the bullet to cause fragmentation, reducing the chance for unintentional harm. However, if bullet velocity is not optimal, then the front of the bullet may only slightly expand, or not expand at all. Often, the forward part of a ballistic-tip bullet may expand slightly and then be sheared off, leaving a cylindrical projectile to travel through and exit the target, transferring less kinetic energy to the target and increasing the probability of unintentional harm.

Some projectiles in the art use a cylindrical fluid-filled cavity to exert a radial expanding force. Fluid-filled bullets can offer advantages over hollow-point and ballistic-tip bullets. First, there is no hollow point to clog or malfunction as in a hollow-point bullet. Second, fluid-filled bullets can expand more rapidly than either hollow-point or ballistic-tip bullets. Fluid-filled bullets can offer greater expansion at a given velocity than either a hollow-point or a ballistic-tip bullet.

U.S. Pat. No. 5,349,907 to Petrovich discloses a projectile having a cylindrical cavity containing a fluid and a shaft at the front of the cavity. Upon impact, the shaft is driven into the fluid, exerting a radial force on the projectile. U.S. Pat. No. 3,429,263 to Snyder discloses a plastic bullet for dispensing paint onto the surface of a target, with the bullet carrying the paint in a tubular cavity. U.S. Pat. No. 6,675,718 to Parker teaches a method for making a fluid-filled projectile by first assembling a fluid-filled cylinder or capsule, and then inserting the cylinder into a hollow cavity of a bullet.

Despite the potential advantages of fluid-filled bullets as conventionally taught, they have had extremely limited commercial success. One reason for the lack of success is the fact that conventional fluid-filled bullets exhibit unpredictable expansion and minimal penetration. Penetration and expansion are important factors when the military, law enforcement agencies, or hunters choose which bullet they are going to use. Unfortunately, bullets that penetrate often exhibit poor expansion and vice-versa. For example, conventional hollow-point bullets may rapidly expand but exhibit poor penetration through car doors, armor, or similar targets. On the other hand, armor-piercing or fully-jacketed rounds may show good penetration through body armor or bone, for example, but generally do not expand reliably and therefore do not transfer maximum kinetic energy to the target.

Accordingly, there is a need in the art for projectiles that can offer enhanced expansion, penetration, or a combination of both penetration and expansion. Such a projectile would be useful in numerous military, law enforcement, and sporting applications.

All the references described above and below are incorporated by reference in their entirety for all useful purposes.

SUMMARY OF THE INVENTION

One embodiment of the present invention provides a projectile containing a non-Newtonian fluid. Another embodiment of the present invention provides a projectile comprising a body and a channel located in the body, with the channel containing a non-Newtonian fluid. A plunger is located in the channel, wherein the plunger transmits a force to the non-Newtonian fluid upon interacting with a target, causing the non-Newtonian fluid to exert a pressure within the channel. Any non-Newtonian fluid can be used with embodiments of the present invention, including shear-thickening, time-thickening, shear-thinning, time-thinning, and plastic solids, and combinations thereof, and the non-Newtonian fluid of any embodiment can be in one or more states or phases, including but not limited to liquid, solid, rigid, semi-rigid, gelatinous, and powdered.

A further embodiment of the present invention provides a projectile comprising a body, with a channel located in the body, wherein the channel contains a non-Newtonian fluid. A recess is located in the channel, wherein the recess can direct a pressure received from the non-Newtonian fluid. A plunger is located in the channel, wherein the plunger transmits a force to the non-Newtonian fluid upon interacting with a target, causing the non-Newtonian fluid to exert the pressure on the recess located in the channel.

Yet another embodiment of the present invention provides a projectile comprising a body, with a channel located in the body. The channel contains a non-Newtonian fluid. A plurality of recesses is located in the channel, wherein the plurality of recesses can direct a pressure received from the non-Newtonian fluid. A plunger is located in the channel, wherein the plunger transmits a force to the non-Newtonian fluid upon interacting with a target, causing the non-Newtonian fluid to exert the pressure on the plurality of recesses located in the channel.

Another embodiment of the present invention provides a projectile comprising a body and a channel located in the body, with the channel containing a non-Newtonian fluid. A plunger is located in the channel, wherein the plunger transmits a force to the non-Newtonian fluid upon interacting with a target, causing the non-Newtonian fluid to exert a pressure in the channel, and wherein the viscosity of the non-Newtonian fluid increases upon interacting with the target. The viscosity of the non-Newtonian fluid can increase with at least one of the rate, amount, or time of shear upon interacting with the target. The projectile can further comprise one or more recesses to direct the pressure received from the non-Newtonian fluid. A recess in any embodiment can further comprise two or more surfaces that join at an apex to focus the pressure on the body.

Another embodiment of the present invention provides a projectile comprising a body and a channel located in the body, with the channel containing a non-Newtonian fluid. A plunger is located in the channel, wherein the plunger transmits a force to the non-Newtonian fluid upon interacting with a target, causing the non-Newtonian fluid to exert a pressure in the channel, and wherein the viscosity of the non-Newtonian fluid decreases as a function of at least one of shear rate, amount, or time upon interacting with the target. The projectile can further comprise one or more recesses to direct the pressure received from the non-Newtonian fluid. A recess can further comprise two or more surfaces that join at an apex to focus the pressure on the body.

Another embodiment of the present invention provides a projectile comprising a body and a channel located in the body, with the channel containing a non-Newtonian fluid comprising at least a shear-thickening fluid. A plunger is located in the channel, wherein the plunger transmits a force to the non-Newtonian fluid upon interacting with a target, causing the non-Newtonian fluid to exert a pressure in the channel, and wherein the viscosity of the shear-thickening fluid increases with at least shear rate upon interacting with the target. The projectile can further comprise one or more recesses to direct the pressure received from the non-Newtonian fluid. A recess can further comprise two or more surfaces that join at an apex to focus the pressure on the body.

Another embodiment of the present invention provides a projectile comprising a body and a channel located in the body, with the channel containing a non-Newtonian fluid comprising at least a time-thickening fluid. A plunger is located in the channel, wherein the plunger transmits a force to the non-Newtonian fluid upon interacting with a target, causing the non-Newtonian fluid to exert a pressure in the channel, and wherein the viscosity of the time-thickening fluid increases with at least one of shear amount or time upon interacting with the target. The projectile can further comprise one or more recesses to direct the pressure received from the non-Newtonian fluid. A recess can further comprise two or more surfaces that join at an apex to focus the pressure on the body.

Another embodiment of the present invention provides a projectile comprising a body and a channel located in the body, with the channel containing a non-Newtonian fluid comprising at least a shear-thinning fluid. A plunger is located in the channel, wherein the plunger transmits a force to the non-Newtonian fluid upon interacting with a target, causing the non-Newtonian fluid to exert a pressure in the channel, and wherein the viscosity of the shear-thinning fluid decreases with at least shear rate upon interacting with the target. The projectile can further comprise one or more recesses to direct the pressure received from the non-Newtonian fluid. A recess can further comprise two or more surfaces that join at an apex to focus the pressure on the body.

Another embodiment of the present invention provides a projectile comprising a body and a channel located in the body, with the channel containing a non-Newtonian fluid comprising at least a time-thinning fluid. A plunger is located in the channel, wherein the plunger transmits a force to the non-Newtonian fluid upon interacting with a target, causing the non-Newtonian fluid to exert a pressure in the channel, and wherein the viscosity of the time-thinning fluid decreases with at least one of shear time or time upon interacting with the target. The projectile can further comprise one or more recesses to direct the pressure received from the non-Newtonian fluid. A recess can further comprise two or more surfaces that join at an apex to focus the pressure on the body.

Another embodiment of the present invention provides a projectile comprising a body and a channel located in the body, with the channel containing a non-Newtonian fluid comprising at least a Bingham plastic. A plunger is located in the channel, wherein the plunger transmits a force to the non-Newtonian fluid upon interacting with a target, causing the non-Newtonian fluid to exert a pressure in the channel, and wherein the viscosity of the Bingham plastic decreases as a function of at least shear rate upon interacting with the target. The projectile can further comprise one or more recesses to direct the pressure received from the non-Newtonian fluid. A recess can further comprise two or more surfaces that join at an apex to focus the pressure on the body.

Another embodiment of the present invention provides a projectile comprising a body and a channel located in the body, with the channel containing a non-Newtonian fluid comprising at least a plastic solid. A plunger is located in the channel, wherein the plunger transmits a force to the non-Newtonian fluid upon interacting with a target, causing the non-Newtonian fluid to exert a pressure in the channel, and wherein the viscosity of the plastic solid decreases with at least one of shear rate, amount, or time upon interacting with the target. The projectile can further comprise one or more recesses to direct the pressure received from the non-Newtonian fluid. A recess can further comprise two or more surfaces that join at an apex to focus the pressure on the body.

Unless otherwise expressly stated, it is in no way intended that any embodiment set forth herein be construed as requiring that its steps or process, if any, be performed in a specific order. This holds for any possible non-express basis for interpretation, including matters of logic with respect to arrangement of steps or operational flow, plain meaning derived from grammatical organization or punctuation, or the number or type of embodiments described in the specification.

BRIEF DESCRIPTION OF THE DRAWINGS

The accompanying drawings, which are incorporated in and constitute part of this specification, illustrate embodiments of the invention, and together with the description, serve to explain the principles of the invention. The embodiments described in the drawings and specification in no way limit or define the scope of the present invention.

Figure 1D:
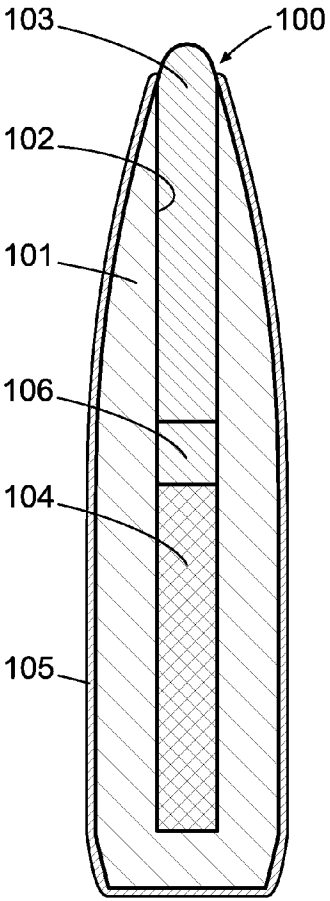
FIG. 1D is a sectional side view of another embodiment of the present invention.

The present invention has been illustrated in relation to embodiments which are intended in all respects to be illustrative rather than restrictive. Those skilled in the art will realize that the embodiments of the present invention are capable of many modifications and variations without departing from the scope of the present invention.

DETAILED DESCRIPTION OF THE INVENTION

The embodiments of the present invention generally provide or relate to projectiles containing one or more non-Newtonian fluids. A non-Newtonian fluid is a fluid in which the viscosity changes with the applied rate of strain or with the duration of stress. There are several types of non-Newtonian fluids, including shear-thickening, time-thickening, shear-thinning, and time-thinning fluids. For an overview of non-Newtonian fluids, see R. Shankar Subramanian, *Non-Newtonian Flows,* 2002. Non-Newtonian fluids can be found in various states or phases, including but not limited to liquid, solid, rigid, semi-rigid, gelatinous, and powdered, and they can exhibit multiple non-Newtonian characteristics at the same time, or at different shear rates, shear times, or temperatures.

A shear-thickening or dilatant fluid increases its viscosity as a function of shear rate. Shear-thickening fluids include suspensions and dispersions of particles in a solvent. U.S. Pat. No. 7,226,878 to Wagner et al. Shear-thickening in suspensions and dispersions is due to the creation of hydroclusters that result from hydrodynamic forces between particles. Wetzel and Wagner, *Novel Flexible Body Armor Utilizing Shear-thickening Fluid* (*STF*) *Composite,* 14th International Conference on Composite Materials, San Diego, Calif., 14 Jul. 2003. Shear-thickening fluids include mixtures of corn starch or talcum with water. Kurchan and Sellitto, *Shear-thickening and the glass transition*, PMMH-ESPCI, Paris, 2006. Corn starch and water combined to form a shear-thickening fluid is sometimes called "Oobleck." As an example of a shear-thickening response, a person can run across a pool of Oobleck; however, if the person stops in place, he or she will quickly sink in.

A time-thickening or rheopectic fluid increases its viscosity as a function of shear and time. SILLY PUTTY, which has time-thickening properties, is a silicone-based material produced by DOW CORNING Corporation under the name of DOW CORNING 3179. The non-Newtonian properties of SILLY PUTTY derive in-part from the presence of Polydimethylsiloxane ("PDMS") and boric acid. PDMS is a widely used silicon-based organic polymer that is known for its non-Newtonian properties. *The Cambridge Polymer Group SILLY PUTTY™ "Egg", Cambridge Polymer Group,* 2002. At long flow times (or high temperatures), PDMS acts like a viscous liquid, similar to honey, but at short flow times (or low temperatures) it acts like an elastic solid, similar to rubber. At short times, such as when a ball of SILLY PUTTY is bounced off of a surface, the Boric acid contributes substantial time-thickening properties by dynamically forming bonds between adjacent molecules. Gypsum pastes are also time-thickening fluids.

A shear-thinning fluid decreases its viscosity as a function of shear rate. Non-drip paint and paint thinner are examples of shear-thinning fluids. A time-thinning or thixotropic fluid decreases its viscosity as a function of shear and time. R. Shankar Subramanian, *Non-Newtonian Flows,* 2002. Many gels are thixotropic materials, exhibiting a stable form at rest but becoming fluid when shear is applied.

Plastic solids are another type of substance that can exhibit non-Newtonian properties, and they include materials that are yield dilatant, yield pseudo-plastic, viscoplastic, or perfectly plastic. A perfectly plastic material is a material wherein a strain does not result in opposing stress. A yield pseudo-plastic material is a pseudo-plastic above some critical shear stress, and a yield dilatant is a dilatant above some critical shear stress. A viscoplastic, such as a Bingham plastic, acts like a solid at rest, but will flow after a threshold shear stress is reached. Grease, toothpaste, and mayonnaise are examples of Bingham plastics.

Accordingly, one embodiment of the present invention provides a projectile containing a non-Newtonian fluid. The non-Newtonian fluid of any embodiment of the present invention can comprise at least a shear-thickening fluid, such as the embodiments of FIGS. 1-4. A shear-thickening fluid in any embodiment can comprise particles suspended or dispersed in a solvent. The particles can be made of numerous natural or synthetic materials, including polymers such as polystyrene or polymethylmethacrylate, polymers from emulsion polymerization, calcium carbonate, and oxides including $SiO_2$. The particles can be any shape, including disk-like, spherical, and elliptical. Adsorbed surfactants, adsorbed polymers, grafted polymers, Brownian motion, or charge can be used to disperse the particles in a solvent. A wide range of particle sizes can be employed, such as 10 to 1000 microns, and larger. Aqueous, silicon-based, or organic solvents, or mixtures thereof, can be used to create a shear-thickening fluid. For example, a shear-thickening fluid can comprise 450 micron spherical silica particles in an ethylene or polyethylene glycol containing solvent. The non-Newtonian fluid of any embodiment can also include one or more additional substances, including stabilizers, fillers, binders, or other substances in any state. The non-Newtonian fluid can also comprise starch particles in a solvent, such as water. However, any suitable shear-thickening fluid can be used.

When the projectile of embodiments of the present invention interacts with a target a force is exerted on the shear-thickening fluid, causing the viscosity of the shear-thickening fluid to increase with at least shear rate, thereby enabling the projectile to penetrate the target. Thereafter, when the force on the shear-thickening fluid decreases, such as when the projectile has lost energy after penetrating the exterior of the target, the shear-thickening fluid can act like a fluid and promote expansion.

The non-Newtonian fluid of any embodiment can also comprise at least a time-thickening fluid. Time-thickening fluids include silicone-based compounds. In various embodiments, such as the embodiments of FIGS. 1-4, the time-thickening fluid can comprise a base compound, such as a silicon-containing or organic compound that includes molecules which contribute time-thickening properties by dynamically forming bonds in response to shear, such as boron molecules. A silicone-based compound, such as SILLY PUTTY, can include Polydimethylsiloxane. Likewise, the time-thickening fluid can include other Polydimethylsiloxane-containing compounds. The time-thickening fluid can also comprise Gypsum paste. However, any appropriate time-thickening fluid can be used.

As with shear-thickening fluids, when the projectile of embodiments of the present invention interacts with a target, such as by striking the target, the time-thickening fluid can act like a solid by increasing its viscosity as a function of shear and time, enabling, for example, the projectile to penetrate a target. Thereafter, the shear-thickening fluid can act like a fluid and promote expansion.

The non-Newtonian fluid of any embodiment can comprise at least a shear-thinning fluid. The shear-thinning fluid of any embodiment can include solutions or suspensions of Guar gum, Xanthan gum, Karaya gum, methylcellulose, lipids, surfactants, and poly vinyl chloride pastes, although any suitable shear-thinning fluid may be used. The non-Newtonian fluid of any embodiment can also comprise at least a time-thinning fluid. The time-thinning fluid of any embodiment can include gels, although any suitable time-thinning fluid may be used.

The projectile of further embodiments of the present invention, including the embodiments of FIGS. 1-4, can include both a thickening fluid, such as a shear-thickening or time-thickening fluid, and a thinning fluid such as a shear-thinning or time-thinning fluid. For example, one embodiment of the present invention can include a shear-thickening fluid to promote initial target penetration as well as include a time-thinning fluid to promote expansion after the projectile has interacted with the target for a sufficient time. Similarly, another embodiment of the present invention can include a time-thickening fluid to promote initial target penetration as well as include a time-thinning fluid to promote expansion after the projectile has interacted with the target for a sufficient time.

The non-Newtonian fluid of any embodiment can also comprise at least one of a yield dilatant, yield pseudo-plastic, Bingham plastic, or perfect plastic. For example, the projectile of any embodiment can contain at least a Bingham plastic. When the projectile is being stored, carried, or handled, the Bingham plastic can act like a solid. When the projectile interacts with a target, the Bingham plastic can act like a fluid and exert a pressure within the projectile, promoting expansion.

Another embodiment of the present invention provides a projectile containing a non-Newtonian fluid, wherein the projectile includes one or more recesses to direct a pressure received from the non-Newtonian fluid. The one or more recesses of any embodiment of the present invention can direct the pressure received from the non-Newtonian fluid to promote expansion. The one or more recesses can be located in a channel that contains the non-Newtonian fluid in embodiments of the present invention. A plunger can be located in the channel of any embodiment to transmit a force to the non-Newtonian fluid upon interaction with a target. Interaction with a target includes any time that the projectile is in contact with the target, including the time of strike or impact through the time of exit. The time of impact includes the time at and around the moment of impact, and the time of exit includes the time at and around the moment of exit. A target includes any object that the projectile interacts with.

The recess of any embodiment can comprise at least two surfaces that join at an apex to focus the pressure on the body, such as a groove, and thereby promote expansion at the apex. A recess in any embodiment can comprise at least a horizontal groove. The horizontal groove can comprise at least two surfaces that join at an apex to focus the pressure on the body. A recess in any embodiment can also comprise at least a vertical groove. The recess of any embodiment can promote expansion of the body by directing the pressure received from the non-Newtonian fluid. The vertical groove can comprise at least two surfaces that join at an apex to focus the pressure on the body. A recess can also comprise a single surface that includes an apex, such as a conical tip. The projectile of any embodiment can comprise a jacket at least partially covering the exterior of the projectile.

The channel of any embodiment of the present invention can be of any suitable size or shape, including cylindrical, spherical, rectangular, polygonal, elliptical, have an increasing or decreasing diameter or area, and be any combination thereof. Similarly, the plunger of embodiments of the present invention can be of any suitable size and shape, including cylindrical, spherical, rectangular, polygonal, elliptical, have an increasing or decreasing diameter or area, and be any combination thereof. The exterior or interior end of the plunger can comprise any suitable shape or geometry, such as a point, a truncated cone, a cylinder, a wedge, a curve, or any combination thereof.

Figure 1C:
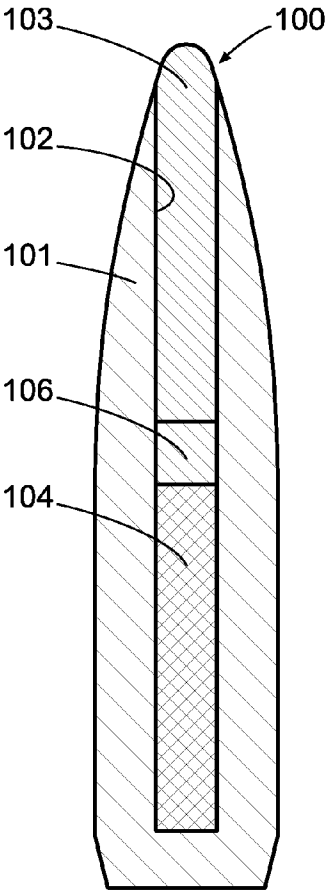
FIG. 1C is a sectional side view of another embodiment of the present invention.
Figure 1B:
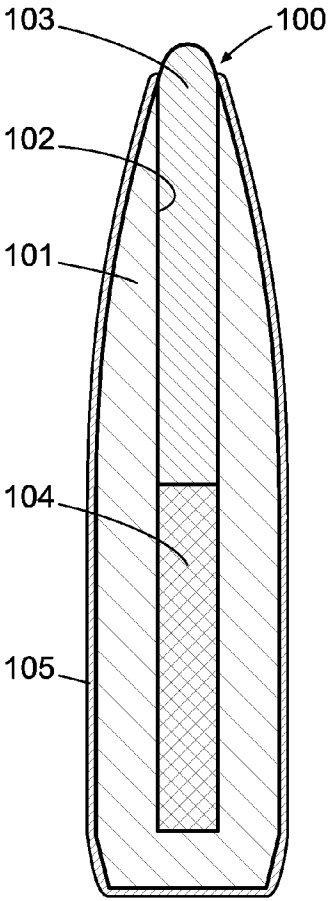
FIG. 1B is a sectional side view of another embodiment of the present invention.
Figure 1A:
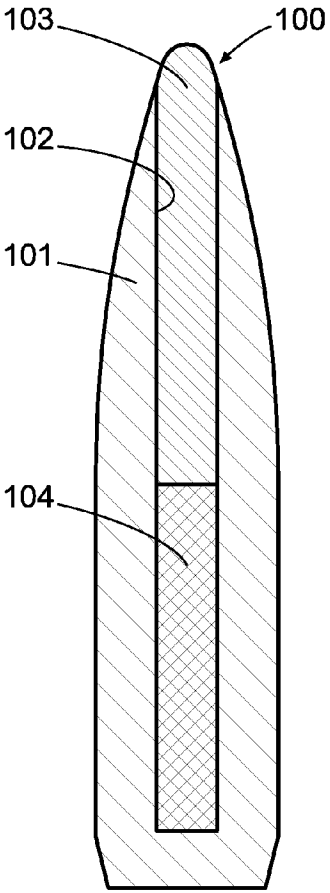
FIG. 1A is a sectional side view of one embodiment of the present invention.

Another embodiment of the present invention as shown in FIG. 1A provides a projectile 100 comprising a body 101 and a channel 102 located in the body 101, with the channel 102 containing a non-Newtonian fluid 104. The non-Newtonian fluid 104 can comprise any non-Newtonian fluid.

In any embodiment of the present invention, the non-Newtonian fluid, such as the non-Newtonian fluid 104, comprises a non-Newtonian fluid that increases or decreases in viscosity upon interacting with a target. In one such embodiment, for example, the non-Newtonian fluid 104 can comprise at least a shear-thickening fluid that increases in viscosity with or as a function of at least the rate of shear upon interacting with a target. The shear-thickening fluid can comprise at least one of a suspension or dispersion of particles in a solvent in any embodiment of the present invention. By way of non-limiting example, the particles can be made of numerous natural or synthetic materials, including polymers such as polystyrene or polymethylmethacrylate, polymers from emulsion polymerization, calcium carbonate, and silica. The particles of any embodiment can be any shape, including disk-like, spherical, and elliptical. Adsorbed surfactants, adsorbed polymers, grafted polymers, Brownian motion, or charge can be used to disperse the particles in a solvent. A wide range of particle sizes can be employed, such as an average size of 30 to 1000 microns, and larger or smaller. Aqueous, silicon-based, or organic solvents, or mixtures thereof, can be used to create a shear-thickening fluid in embodiments of the present invention.

The solvent of any embodiment can be an aqueous solution, such as an aqueous solution including ethylene glycol or polyethylene glycol. The particles of any embodiment, such as the embodiments of FIGS. 1-4, can for example comprise silica or other oxide particles, or combinations thereof, which have an average diameter of 30 to 1000 microns. By way of another example, in one embodiment the non-Newtonian fluid 104 can comprise particles, such as spherical silica particles, having an average diameter of 450 microns in an ethylene glycol or polyethylene glycol containing solvent. Any suitable average diameter can be used in embodiments of the present invention, including but not limited to average particle diameters of 10 to 1000 microns.

The non-Newtonian fluid, such as the non-Newtonian fluid 104, can also comprise at least a time-thickening fluid that increases its viscosity as a function of or with at least the time of shear upon interacting with a target in any embodiment of the present invention. The time-thickening fluid can comprise a silicone-based compound. The silicone-based compound can include Polydimethylsiloxane. The non-Newtonian fluid of any embodiment can have both shear-thickening and time-thickening properties.

A plunger 103 is located in the channel 102, wherein the plunger 103 transmits a force to the non-Newtonian fluid 104 upon interacting with a target, causing the non-Newtonian fluid 104 to exert a pressure in the channel 102. The viscosity of the non-Newtonian fluid 104 changes, such as by increasing or decreasing, upon interacting with the target.

As shown in FIG. 1B, the projectile of FIG. 1A can further comprise a jacket 105. The jacket of any embodiment of the present invention can fully or partially cover the projectile body.

FIG. 1C shows the projectile of FIG. 1A further comprising a compressible material 106 located in the channel. In any embodiment of the present invention the channel can contain a non-Newtonian fluid as well as a compressible material such as a gas or a solid. The gas can comprise air. The compressible material can allow the plunger to travel down the channel for a predetermined length before exerting a threshold force on the non-Newtonian fluid. The type and amount of the compressible material can be chosen to promote expansion and/or penetration. FIG. 1D shows the projectile of FIG. 1B including a compressible material 106.

The plunger of any embodiment of the present invention can be used with the embodiments of FIGS. 1A-1D, such as the plungers shown in FIGS. 5A-5F.

The projectile body, jacket, or plunger of any embodiment of the present invention can be composed of any suitable substance, including metals such as lead, bismuth, tin, nickel, copper, iron, aluminum, tungsten, titanium, uranium, and their alloys, plastics, ceramics, composite materials, or any combination thereof. For example, in any embodiment the projectile body can be unjacketed and comprise a single metal, such as copper or brass, or the projectile body can comprise at least one metal, such as lead, with a metal, such as copper, jacket at least partially covering the projectile body. In another embodiment, the projectile body comprises at least one metal, such as lead or copper, and the plunger can comprise a relatively harder material such as steel, tungsten, titanium, or ceramic to promote target penetration. When embodiments recite that a channel is located in a projectile body, the channel can be contained by or incorporated into any part(s) or component(s) of the projectile.

The transmission of force between the plunger and the non-Newtonian fluid in any embodiment of the present invention includes direct transmission, such as by contact between the non-Newtonian fluid and the plunger, and indirect transmission, such as by or through another object or substance in the projectile, such as by an object between the plunger and the non-Newtonian fluid. For example, the non-Newtonian fluid can be contained within a body residing within the projectile channel of any embodiment of the present invention. When any embodiment of the present invention includes a plunger and a non-Newtonian fluid, the plunger can be located above, on, or at least partially in the non-Newtonian fluid when the projectile is at rest. Similarly, the transmission of force between the non-Newtonian fluid and the projectile body in any embodiment of the present invention includes direct and indirect transmission.

To determine if the non-Newtonian fluid in any embodiment of the present invention experiences a shear rate sufficient to cause it to substantially change viscosity, such as to determine if a given shear-thickening and/or time-thickening fluid experiences sufficient shear upon striking armor, for example, to solidify and thereby promote penetration, one or more projectiles containing the non-Newtonian fluid can be shot at one or more testing apparatuses. For example, projectile embodiments of the present invention can be shot at a metal plate, such as a one-eight inch mild steel plate that simulates armor, and a polyester-filled arresting box or ballistic gelatin can be placed behind the plate to capture projectiles that may pass through the plate. Of course, numerous materials other than a steel plate could be used as a target, such as a Kevlar sheet, a bullet-proof vest, a ceramic plate, sheetrock, ballistic gelatin, wood, plastics, glass, real or simulated barriers such as car doors, or any combination thereof.

If the projectile shows limited deformation after traveling through the plate, for example, then the shear-thickening or time-thickening fluid in the projectile exceeded its critical shear rate or shear amount and shear time, respectively, and acted like a solid, thereby promoting penetration of the plate. By way of non-limiting example, assuming a projectile of the present invention contains a shear-thickening fluid comprising particles, such as silica particles, having an average diameter, such as 100 microns, that are suspended in a solvent such as an aqueous solution of ethylene glycol, the concentration of particles can be readily adjusted to control whether the shear thickening fluid may experience its critical shear rate upon striking a target. Within the limits of a given cartridge (such as the .308 WINCHESTER) incorporating an embodiment of the present invention, one can also therefore determine what minimum velocity (or maximum range to a target) is needed to rigidify the bullet's non-Newtonian fluid and promote penetration of the target. Similarly by way of example the amount of borate (via sodium borate (BORAX), for example) may be readily increased in a silicon-based time-thickening fluid to lower that fluid's critical shear amount and thereby promote penetration. In other embodiments the amount or ratio of a thinning fluid, such as a time-thinning fluid, can be varied in a projectile containing a shear or time-thickening fluid to readily adjust the penetration and expansion of a projectile.

Further regarding embodiments of the present invention, one can also influence the expanding and/or penetrating properties of a projectile by changing features the projectile to vary the shear experienced by the projectile's non-Newtonian fluid upon interacting with a target. By way of non-limiting example, assuming an embodiment of the present invention that contains a shear-thickening fluid and/or time-thickening fluid, the width or shape of the plunger and/or channel can be varied to change the shear experienced by the non-Newtonian fluid upon interacting with a target. Specifically, the shear experienced by a non-Newtonian fluid is a function of the pressure exerted on that fluid upon interacting with a target. Since pressure is equal to force (mass times acceleration) divided by area, the width or shape of the plunger and/or channel can be varied to change the pressure, and therefore shear, experienced by the fluid upon interacting a target. Thus for example the area or width of a plunger or a plunger's bottom portion can be decreased, say from 25 to 20 calibers wide, to increase the shear experienced by the non-Newtonian fluid and thereby promote penetration. Similarly, changing the shape of the bottom of the plunger, from flat to a truncated cone, for example, will also readily increase the shear experienced by the non-Newtonian fluid in embodiments of the present invention. Accordingly, in embodiments of the present invention the non-Newtonian fluid can be selected, such as by varying the concentration, type, or size of particles in a solution, or by changing the amount of a dynamically-linking agent, such as borate, to have a critical shear value that is equal to or greater to a certain value. The relative amount of shear experienced by a non-Newtonian fluid can also be selected by adjusting the width, area, or shape of the bottom portion of the plunger in embodiments of the present invention.

Figure 2D:
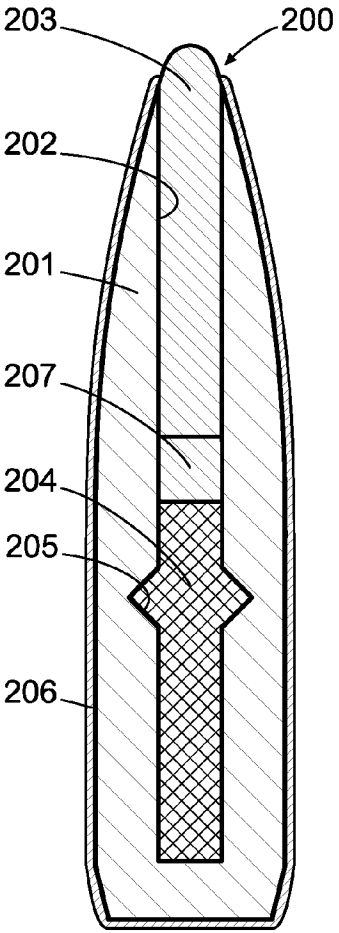
FIG. 2D is a sectional side view of a further embodiment of the present invention.
Figure 2C:
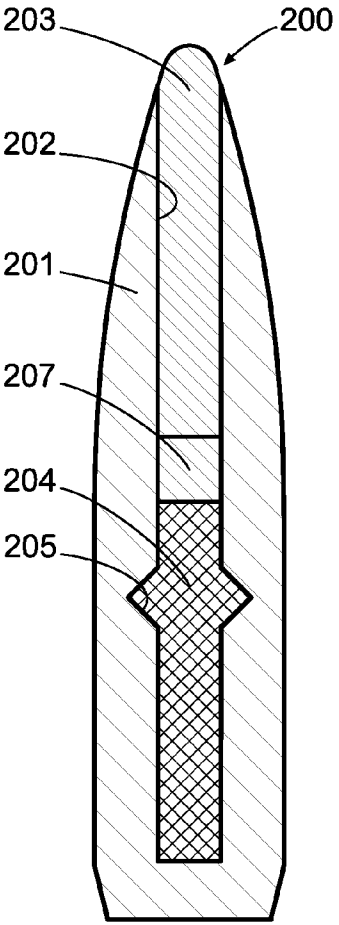
FIG. 2C is a sectional side view of a further embodiment of the present invention.
Figure 2B:
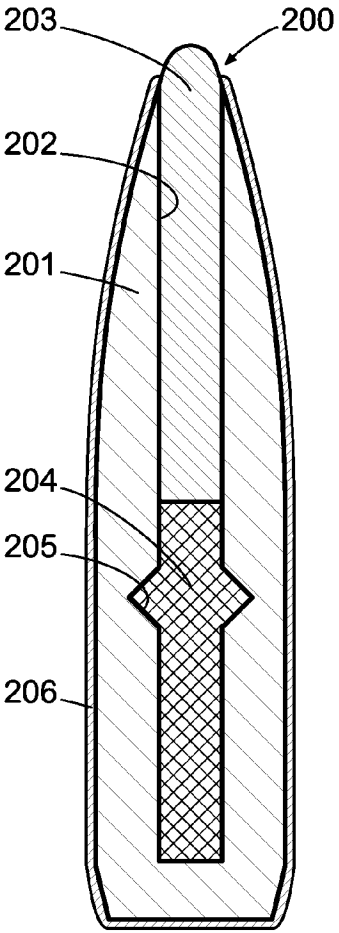
FIG. 2B is a sectional side view of a further embodiment of the present invention.
Figure 2A:
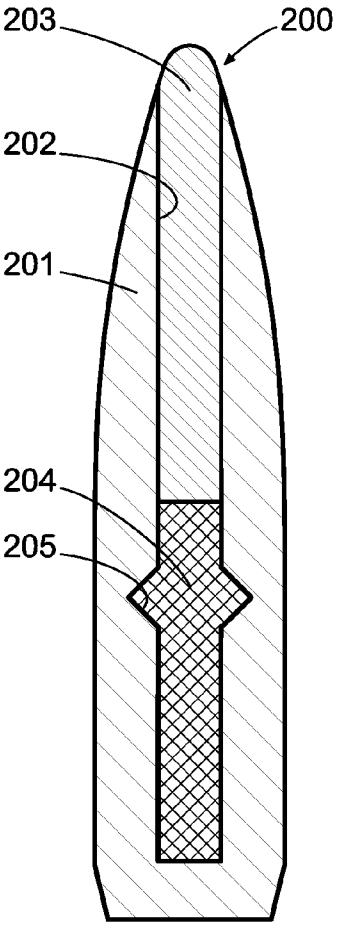
FIG. 2A is a sectional side view of another embodiment of the present invention.

Further embodiments of the present invention as shown in FIG. 2A provide a projectile 200 comprising a body 201, with a channel 202 located in the body 201, wherein the channel 202 contains a non-Newtonian fluid 204. A recess 205 is located in the channel 202, wherein the recess 205 can direct a pressure received from the non-Newtonian fluid 204. A plunger 203 is located in the channel 202, wherein the plunger 203 transmits a force to the non-Newtonian fluid 204 upon interacting with a target, causing the non-Newtonian fluid 204 to exert the pressure on the recess 205 located in the channel 202.

The non-Newtonian fluid 204 can comprise any non-Newtonian fluid. In one embodiment, for example, the non-Newtonian fluid 204 can comprise at least a shear-thickening fluid that increases in viscosity as a result of at least shear rate upon interacting with a target. The shear-thickening fluid can comprise at least one of a suspension or dispersion of particles in a solvent in any embodiment of the present invention, such as in the embodiments of FIG. 2. By way of non-limiting example, the particles can be made of numerous natural or synthetic materials, including polymers such as polystyrene or polymethylmethacrylate, polymers from emulsion polymerization, calcium carbonate, and silica or other oxides. The particles of any embodiment can be any shape, including disk-like, spherical, and elliptical. Adsorbed surfactants, adsorbed polymers, grafted polymers, Brownian motion, or charge can be used to disperse the particles in a solvent. A wide range of particle sizes can be employed, such as 30 to 1000 microns, and larger. Aqueous, silicon-based, or organic solvents, or mixtures thereof, can be used to create a shear-thickening fluid in embodiments of the present invention. By way of non-limiting example, the solvent can include ethylene glycol or polyethylene glycol in the embodiments of FIG. 2. The particles, such as silica or other oxides particles can have an average diameter of 30 to 1000 microns, for example. For example, in one embodiment the non-Newtonian fluid 204 can comprise spherical silica particle having an average diameter of less than 1000 microns in an ethylene glycol or polyethylene glycol containing solvent.

The non-Newtonian fluid 204 can also comprise at least a time-thickening fluid that increases in viscosity as a result of at least shear amount and shear time upon interacting with a target. The time-thickening fluid can comprise a silicone-based compound. The silicone-based compound can include Polydimethylsiloxane. The non-Newtonian fluid 204 can have both shear-thickening and time-thickening properties.

The projectile 200 can further comprise a jacket 206 as shown in FIG. 2B. FIG. 2C shows the projectile of FIG. 2A further comprising a compressible material 207 located in the channel 202. FIG. 2D shows the projectile of FIG. 2B including a compressible material 207. The plunger of any embodiment of the present invention can be used with the embodiments of FIGS. 2A-2D, such as the plungers shown in FIGS. 5A-5F.

In the embodiments of FIGS. 2A-2D the recess 205 is a v-shaped groove parallel to the horizontal axis of the projectile 200. As seen in FIG. 2A the horizontal recess 205 includes an upper surface and a lower surface joined at an apex. When the plunger 203 travels down the channel 202 and exerts a force on the non-Newtonian fluid 204, that force, in turn, is exerted at every point in the channel 202 which is in contact with the non-Newtonian fluid 204, including at the upper and lower surfaces of the recess 205, when the non-Newtonian fluid 204 is in a liquid state. The forces acting on the upper surface and the forces acting on the lower surface thus have components acting in different directions along the long axis of the projectile 200, focusing a disruptive force at the apex of the upper and lower surfaces. Accordingly, the projectile 200 can expand or separate at one or more points around the projectile 200 near the recess 205.

As shown in FIG. 2A, a recess 205 can be a horizontal groove in embodiments of the present invention. A recess can also be a longitudinal groove. In further embodiments of the present invention a horizontal groove 205 can be combined with a recess of another shape or size. A recess in any embodiment of the present invention can have any size and shape, including spherical, semi-spherical, curved, flat, rectangular, triangular, elliptical, conical, cylindrical, polygonal, or any combination thereof. A recess can be negative, thereby increasing the total closed volume of the channel below the plunger. A recess can also be positive in any embodiment of the present invention, thereby decreasing the total closed volume of the channel below the plunger. The channel in any embodiment of the present invention can be of any size and shape, including curved, cylindrical, rectangular, spherical, semi-spherical, conical, polygonal, or any combination thereof. The channel of any embodiment of the present invention may contain one or more negative recesses as well as one or more positive recesses.

Further embodiments of the present invention as shown in FIGS. 3A-3D provide a projectile 300 comprising a body 301, with a channel 302 located in the body 301. The channel 302 contains a non-Newtonian fluid 304. The non-Newtonian fluid 304 can comprise any non-Newtonian fluid. In one embodiment, for example, the non-Newtonian fluid 304 can comprise at least a shear-thickening fluid that increases in viscosity as a function of at least shear rate upon interacting with a target.

The shear-thickening fluid can comprise at least one of a suspension or dispersion of particles in a solvent in any embodiment of the present invention, such as in the embodiments of FIG. 3. By way of non-limiting example, the particles can be made of numerous natural or synthetic materials, including polymers such as polystyrene or polymethylmethacrylate, polymers from emulsion polymerization, calcium carbonate, and silica. The particles of any embodiment can be any shape, including disk-like, spherical, and elliptical. Adsorbed surfactants, adsorbed polymers, grafted polymers, Brownian motion, or charge can be used to disperse the particles in a solvent. A wide range of particle sizes can be employed, such as 30 to 1000 microns, and larger. Aqueous, silicon-based, or organic solvents, or mixtures thereof, can be used to create a shear-thickening fluid in embodiments of the present invention. For example, the solvent can include ethylene glycol or polyethylene glycol in the embodiments of FIG. 3. By way of further example, in one embodiment the non-Newtonian fluid 304 can comprise silica particle having an average diameter of 30 to 1000 microns in an ethylene glycol or polyethylene glycol solvent.

The non-Newtonian fluid 304 can also comprise at least a time-thickening fluid that increases in viscosity as a function of at least the rate and time of shear upon interacting with a target. The time-thickening fluid can comprise a silicone-based compound. The silicone-based compound can include Polydimethylsiloxane. The non-Newtonian fluid 304 can have both shear-thickening and time-thickening properties.

A plurality of recesses 305 are located in the channel 302, wherein the plurality of recesses 305 can direct a pressure received from the non-Newtonian fluid 304. A plunger 303 is located in the channel 302, wherein the plunger 303 transmits a force to the non-Newtonian fluid 304 upon interacting with a target, causing the non-Newtonian fluid 304 to exert the pressure on the plurality of recesses 305 located in the channel 302. Any non-Newtonian fluid can be used.

Figure 3D:
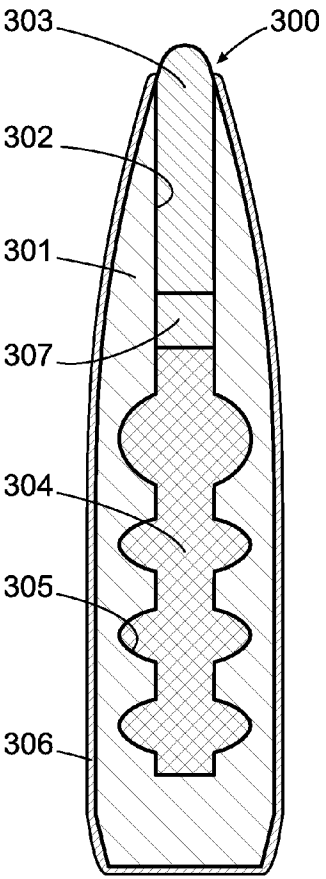
FIG. 3D is a sectional side view of another embodiment of the present invention.
Figure 3C:
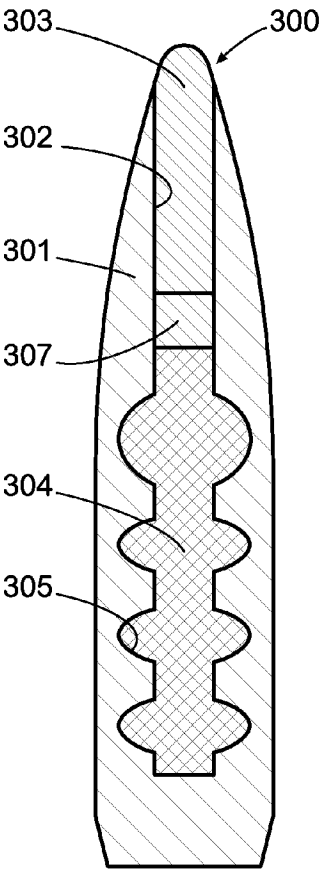
FIG. 3C is a sectional side view of another embodiment of the present invention.
Figure 3B:
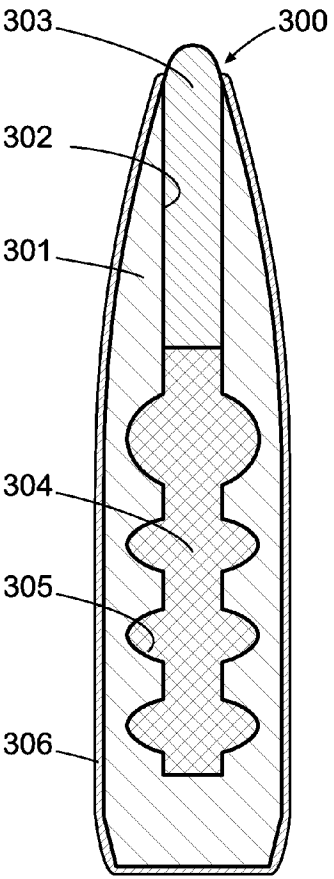
FIG. 3B is a sectional side view of another embodiment of the present invention.
Figure 3A:
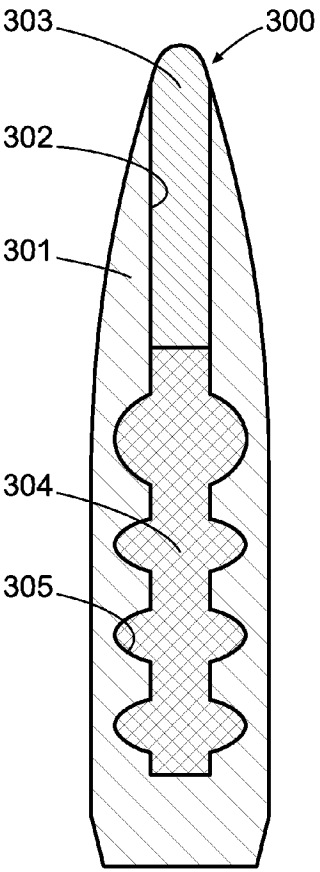
FIG. 3A is a sectional side view of a further embodiment of the present invention.

The projectile 300 of FIG. 3A can further comprise a jacket as shown in FIG. 3B, and the projectile 300 of FIG. 3C can further comprise a jacket as shown in FIG. 3D. The projectile 300 can further comprise a jacket 306 as shown in FIG. 3B. FIG. 3C shows the projectile of FIG. 3A further comprising a compressible material 307 located in the channel 302. FIG. 3D shows the projectile of FIG. 3B including a compressible material 307. The plunger of any embodiment of the present invention can be used with the embodiments of FIGS. 3A-3D, such as the plungers shown in FIGS. 5A-5F.

Figure 4A:
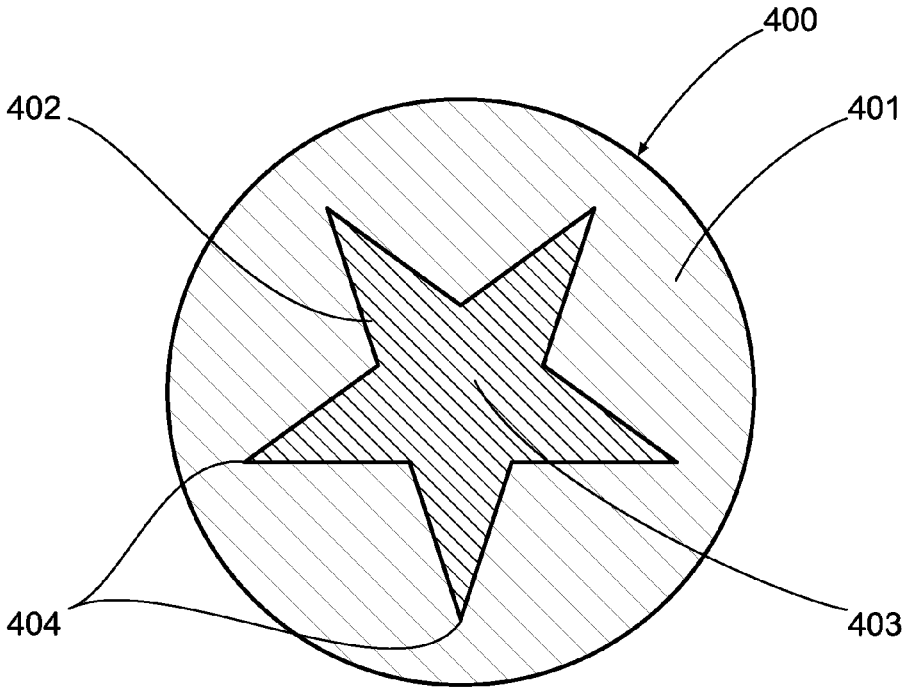
FIG. 4A is a sectional top view of a further embodiment of the present invention.

In any embodiment of the invention, such as those depicted in FIG. 4, a projectile 400 having a body 401 with a channel 402 is provided. The channel 402 contains a non-Newtonian fluid 403. The non-Newtonian fluid 403 can comprise any non-Newtonian fluid. In one embodiment, for example, the non-Newtonian fluid 403 can comprise at least a shear-thickening fluid that increases in viscosity with at least the rate of shear upon interacting with a target.

The shear-thickening fluid can comprise at least one of a suspension or dispersion of particles in a solvent in any embodiment of the present invention, such as in the embodiments of FIG. 4. By way of non-limiting example, the particles can be made of numerous natural or synthetic materials, including polymers such as polystyrene or polymethylmethacrylate, polymers from emulsion polymerization, calcium carbonate, silica, or other oxides. The particles of any embodiment can be any shape, including disk-like, spherical, and elliptical. Adsorbed surfactants, adsorbed polymers, grafted polymers, Brownian motion, or charge can be used to disperse the particles in a solvent. A wide range of particle sizes can be employed, such as 30 to 1000 microns, and larger or smaller. Aqueous, silicon-based, or organic solvents, or mixtures thereof, can be used to create a shear-thickening fluid in embodiments of the present invention. For example, the solvent can include ethylene glycol or polyethylene glycol in the embodiments of FIG. 4. By way of further example, in one embodiment the non-Newtonian fluid 403 can comprise spherical, elliptical, and/or irregularly shaped silica particle having an average diameter of 450 microns in an ethylene glycol or polyethylene glycol containing solvent.

The non-Newtonian fluid 403 can also comprise at least a time-thickening fluid that increases in viscosity with at least the amount and time of shear upon interacting with a target. The time-thickening fluid can comprise a silicone-based compound. The silicone-based compound can include Polydimethylsiloxane. The non-Newtonian fluid 403 can have both shear-thickening and time-thickening properties.

Figure 4B:
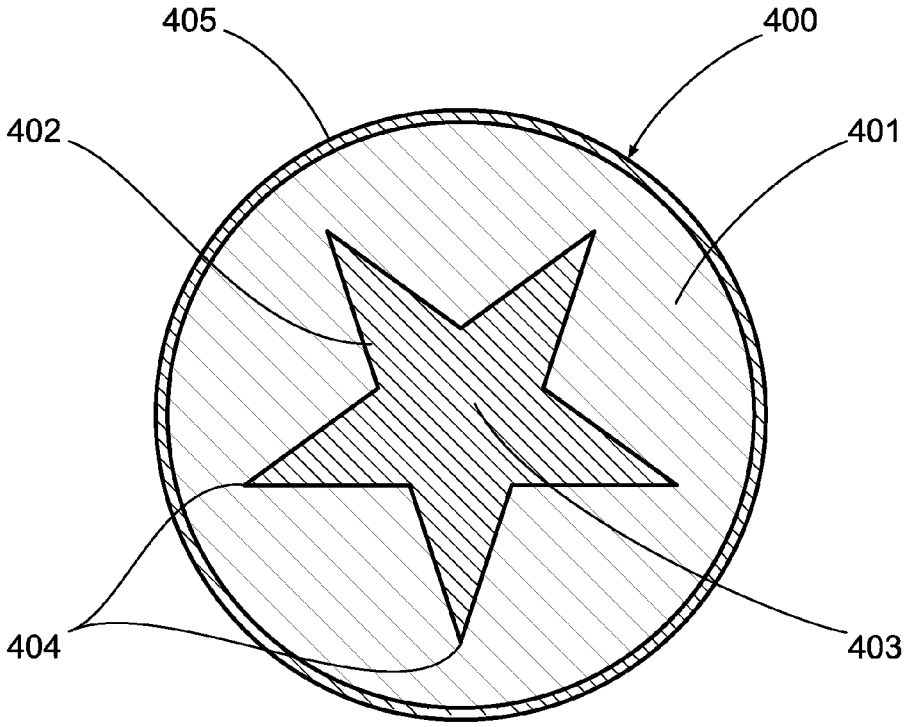
FIG. 4B is a sectional top view of a further embodiment of the present invention.

The channel 402 can have one or more longitudinal grooves 404 that can direct a pressure received from the non-Newtonian fluid 403. A plunger (not shown) is located in the channel 402, wherein the plunger transmits a force to the non-Newtonian fluid 403 upon interacting with a target, causing the non-Newtonian fluid 403 to exert the pressure on the longitudinal grooves 404 located in the channel 402. The projectile 400 can further comprise a jacket 405 as shown in FIG. 4B. The plunger of any embodiment of the present invention can be used with the projectile 400, such as the plunger shown in the embodiments of FIGS. 5A-5F. In further embodiments of the present invention the longitudinal grooves 404 can be combined with one or more recesses of other shapes or sizes, such as a horizontal groove.

Figure 5A:
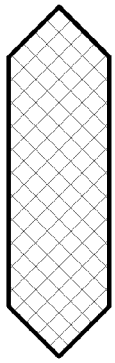
FIG. 5A is a sectional side view of a plunger useable with any embodiment of the present invention.

FIG. 5A depicts a plunger that can be used with the projectile of any embodiment of the present invention. As seen in FIG. 5A, the bottom of the plunger comprises a point. The point can be located in, on, or above the non-Newtonian fluid of any projectile of the present invention. The top portion of the plunger of any embodiment of the present invention can have any shape, including pointed, curved, truncated, flat, or any combination thereof, and it can protrude beyond the front of the projectile, be flush with the end of the projectile, or it may be recessed in the front of the projectile.

Figure 5B:
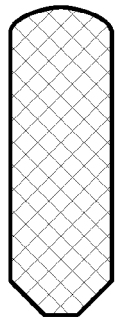
FIG. 5B is a sectional side view of another plunger useable with any embodiment of the present invention.

FIG. 5B depicts another plunger that can be used with the projectile of any embodiment of the present invention. As seen in FIG. 5B, the bottom of the plunger comprises a truncated cone. The truncated cone can be located in, on, or above the non-Newtonian fluid of any projectile of the present invention.

Figure 5C:
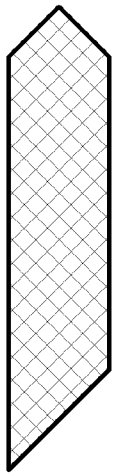
FIG. 5C is a sectional side view of another plunger useable with any embodiment of the present invention.

FIG. 5C depicts another plunger that can be used with the projectile of any embodiment of the present invention. As seen in FIG. 5C, the bottom of the plunger comprises a wedge. The point can be located in, on, or above the non-Newtonian fluid of any projectile of the present invention.

Figure 5D:
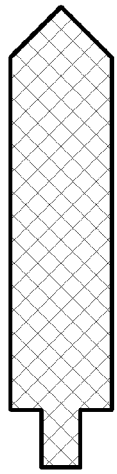
FIG. 5D is a sectional side view of another plunger useable with any embodiment of the present invention.

FIG. 5D depicts another plunger that can be used with the projectile of any embodiment of the present invention. As seen in FIG. 5D, the bottom of the plunger comprises cylinder. The bottom-most portion of the cylinder can be located in, on, or above the non-Newtonian fluid of any projectile of the present invention.

Figure 5E:
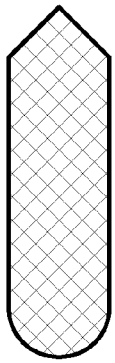
FIG. 5E is a sectional side view of another plunger useable with any embodiment of the present invention.

FIG. 5E depicts another plunger that can be used with the projectile of any embodiment of the present invention. As seen in FIG. 5E, the bottom of the plunger is rounded. The bottom-most portion of the plunger can located in, on, or above the non-Newtonian fluid of any projectile of the present invention.

Figure 5F:
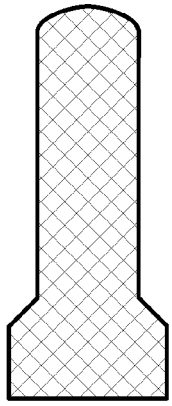
FIG. 5F is a sectional side view of another plunger useable with any embodiment of the present invention.

FIG. 5F depicts another plunger that can be used with the projectile of any embodiment of the present invention. As seen in FIG. 5F, the bottom of the plunger has an increased diameter, which can be used, for example, when a lower portion of the channel has a larger diameter than a top portion of the channel. The bottom portion or tip of any plunger can be used with the plunger embodiment of FIG. 5F, such as the plunger embodiments shown in FIGS. 5A-5E.

While the invention has been described in detail in connection with specific embodiments, it should be understood that the invention is not limited to the above-disclosed embodiments. Rather, the invention can be modified to incorporate any number of variations, alternations, substitutions, or equivalent arrangements not heretofore described, but which are commensurate with the spirit and scope of the invention. Specific embodiments should be taken as exemplary and not limiting.

I claim:

1. A bullet that uses a non-Newtonian fluid to promote penetration of a target, the bullet comprising:

a. a body including a channel, wherein the channel contains the non-Newtonian fluid; and b. a plunger that is harder than the body and located in the channel, wherein the plunger transmits a force to the non-Newtonian fluid while in contact with the target, causing the non-Newtonian fluid to exert a pressure in the channel, and wherein the viscosity of the non-Newtonian fluid increases with at least one of a shear rate or a shear time while the plunger is in contact with the target, thereby promoting penetration of the target.

2. The bullet of claim 1, wherein the channel includes a compressible material.

3. The bullet of claim 1, wherein the channel includes one or more recesses to direct the pressure received from the non-Newtonian fluid.

4. The bullet of claim 1, wherein the non-Newtonian fluid acts like a solid in response to at least one of the shear rate or the shear time.

5. The bullet of claim 4, wherein the bullet comprises a centerfire rifle bullet.

6. The bullet of claim 4, wherein the plunger comprises at least one of steel, tungsten, titanium, and aluminum.

7. The bullet of claim 4, wherein the body comprises at least one of lead, bismuth, and copper.

8. The bullet of claim 7, wherein the bullet comprises a centerfire rifle bullet.

9. The bullet of claim 1, wherein the bullet comprises a centerfire rifle bullet.

10. The bullet of claim 1, wherein the plunger comprises at least one of steel, tungsten, titanium, and aluminum.

11. The bullet of claim 1, wherein the body comprises at least one of lead, bismuth, and copper.

12. The bullet of claim 11, wherein the bullet comprises a centerfire rifle bullet.

13. A bullet that uses a shear-thickening fluid to promote penetration of a target, the bullet comprising:

a. a body including a channel, wherein the channel contains the shear-thickening fluid; and b. a plunger located in the channel, wherein the plunger transmits a force to the shear-thickening fluid while in contact with the target, causing the shear-thickening fluid to exert a pressure in the channel, and wherein the viscosity of the shear-thickening fluid increases with at least a rate of shear while the plunger is in contact with the target, thereby promoting penetration of the target.

14. The bullet of claim 13, wherein the plunger comprises a material that is harder than the body.

15. The bullet of claim 14, wherein the body comprises at least one of lead, bismuth, and copper, and wherein the plunger comprises at least one of steel, tungsten, titanium, and aluminum.

16. The bullet of claim 13, wherein the channel includes a compressible material.

17. The bullet of claim 13, wherein the channel includes one or more recesses to direct the pressure received from the shear-thickening fluid.

18. The bullet of claim 13, wherein the shear-thickening fluid comprises at least one of a suspension or dispersion of particles in an aqueous solution.

19. The bullet of claim 18, wherein the particles have an average diameter of 10 to 1000 microns.

20. The bullet of claim 18, wherein the particles comprise at least one of polymer, silica, calcium carbonate, or oxide particles.

21. The bullet of claim 18, wherein the solution includes at least one of ethylene glycol or polyethylene glycol.

22. The bullet of claim 13, wherein the shear-thickening fluid acts like a solid in response the shear rate.

23. The bullet of claim 22, wherein the body comprises at least one of lead, bismuth, and copper, and wherein the plunger comprises at least one of steel, tungsten, titanium, and aluminum.

24. A bullet that uses a time-thickening fluid to promote penetration of a target, the bullet comprising:

a. a body including a channel, wherein the channel contains the time-thickening fluid; and b. a plunger located in the channel, wherein the plunger transmits a force to the time-thickening fluid while in contact with the target, causing the time-thickening fluid to exert a pressure in the channel, and wherein the viscosity of the time-thickening fluid increases with at least a shear time while the plunger is in contact with the target, thereby promoting penetration of the target.

25. The bullet of claim 24, wherein the plunger comprises a material that is harder than the body.

26. The bullet of claim 25, wherein the plunger comprises at least one of steel, tungsten, titanium, and aluminum.

27. The bullet of claim 14, wherein the body comprises at least one of lead, bismuth, and copper.

28. The bullet of claim 14, wherein the time-thickening fluid comprises a base compound.

29. The bullet of claim 28, wherein the base compound includes a silicon-based organic polymer.

30. The bullet of claim 29, wherein the base compound includes Polydimethylsiloxane.

31. The bullet of claim 30, wherein the time-thickening fluid includes boron.

32. The bullet of claim 31, wherein the bullet comprises a centerfire rifle bullet.

33. The bullet of claim 24, wherein the channel includes a compressible material.

34. The bullet of claim 24, wherein the channel includes one or more recesses to direct the pressure received from the time-thickening fluid.

35. The bullet of claim 24, wherein the time-thickening fluid comprises a base compound.

36. The bullet of claim 35, wherein the base compound includes a silicon-based organic polymer.

37. The bullet of claim 36, wherein the base compound includes Polydimethylsiloxane.

38. The bullet of claim 37, wherein the time-thickening fluid includes boron.

39. The bullet of claim 24, wherein the time-thickening fluid acts like a solid in response to the shear time.

40. The bullet of claim 39, wherein the plunger comprises a material that is harder than the body.

41. The bullet of claim 40, wherein the plunger comprises at least one of steel, tungsten, titanium, and aluminum.

42. The bullet of claim 40, wherein the body comprises at least one of lead, bismuth, and copper.

43. The bullet of claim 40, wherein the time-thickening fluid comprises a base compound.

44. The bullet of claim 43, wherein the base compound includes a silicon-based organic polymer.

45. The bullet of claim 44, wherein the base compound includes Polydimethylsiloxane.

46. The bullet of claim 45, wherein the time-thickening fluid includes boron.

47. The bullet of claim 46, wherein the bullet comprises a centerfire rifle bullet.

* * * * *